US010464806B1

(12) United States Patent
Shackleford

(10) Patent No.: US 10,464,806 B1
(45) Date of Patent: Nov. 5, 2019

(54) PORTABLE SADDLE RACK

(71) Applicant: Kyle Shackleford, Schriever, LA (US)

(72) Inventor: Kyle Shackleford, Schriever, LA (US)

( * ) Notice: Subject to any disclaimer, the term of this patent is extended or adjusted under 35 U.S.C. 154(b) by 0 days.

(21) Appl. No.: 16/054,909

(22) Filed: Aug. 3, 2018

(51) Int. Cl.
*B68C 1/00* (2006.01)
*B68B 9/00* (2006.01)

(52) U.S. Cl.
CPC ..... *B68C 1/002* (2013.01); *B68B 9/00* (2013.01)

(58) Field of Classification Search
CPC ..... B68C 1/002; B68B 9/00
USPC ..... 211/85.11
See application file for complete search history.

(56) References Cited

U.S. PATENT DOCUMENTS 378,201 A * 2/1888 Jacoby ..... A47G 25/0607 248/304
2,740,532 A * 4/1956 Kleinsmith ..... B60R 7/08 211/104
2,760,746 A * 8/1956 Botolfsen ..... B68C 1/002 211/85.11
2,952,366 A * 9/1960 Botten ..... B68C 1/002 211/104
3,147,606 A * 9/1964 Holmberg ..... A47B 81/007 108/129
D199,988 S * 1/1965 Kadison ..... 211/85.11
3,305,101 A * 2/1967 Mills ..... B68C 1/002 211/106.01
3,662,909 A * 5/1972 Cherry ..... B60P 3/04 104/95
3,688,912 A * 9/1972 Wilmoth ..... A47F 5/08 211/85.11
3,780,971 A * 12/1973 De Filipps ..... B68C 1/002 211/104
3,930,663 A * 1/1976 Scripter ..... B62B 1/042 280/654
D262,323 S * 12/1981 Perkins ..... D30/143
D262,834 S * 1/1982 Perkins ..... D30/143
D262,918 S * 2/1982 Perkins ..... D30/143
D279,829 S * 7/1985 Bartholomew ..... D30/143
4,541,535 A * 9/1985 Bartholomew ..... B68C 1/002 211/85.11
D294,753 S * 3/1988 Otterbein ..... D30/143
4,958,594 A * 9/1990 Swagerty ..... B60P 3/04 119/400

(Continued)

FOREIGN PATENT DOCUMENTS

BE 1008624 A6 * 6/1996 ..... B68C 1/002
CA 2182819 A1 * 2/1998 ..... B68C 1/002

(Continued)

*Primary Examiner* — Stanton L Krycinski
(74) *Attorney, Agent, or Firm* — Norton IP Law Firm; Taylor M. Norton

(57) ABSTRACT

A portable saddle rack is provided for improved mobility, set up, storage and transportation features in order to efficiently anchor, receive, secure, and transport saddles, blankets and bridles of many types in a multitude of environments and destinations. The saddle rack preferably includes a bridal hook, a saddle support, a blanket support and adjustable blanket tensioner, and a plurality of hooks configured to removeably latch onto a horizontal structure such as a horse trailer. Embodiments also preferably include a retention line operatively connected to a vertical retention member, where the retention line is adapted to enwrap a portion of a saddle horn when placed upon the saddle rack.

16 Claims, 10 Drawing Sheets

(56) References Cited

U.S. PATENT DOCUMENTS 5,050,744 A * 9/1991 Floyd ..... B68C 1/002 211/85.11
5,054,628 A * 10/1991 Allen ..... A47B 46/005 211/100
5,101,985 A * 4/1992 Pasban-Dowlatshahi ..... B68C 1/002 211/85.11
5,362,078 A * 11/1994 Paton ..... B62B 1/12 280/35
5,474,312 A * 12/1995 Starita ..... B62B 3/10 280/47.19
5,590,795 A * 1/1997 Wright ..... A47B 81/00 211/104
5,615,783 A * 4/1997 Warnken ..... B68C 1/002 211/104
6,616,152 B2 * 9/2003 Oliver ..... B62B 1/12 280/35
6,659,476 B2 * 12/2003 Weida ..... B62B 1/26 211/85.11
6,766,913 B2 * 7/2004 Steen ..... B68C 1/002 211/193
6,929,269 B2 * 8/2005 Oliver ..... B62B 1/12 280/35
D522,186 S * 5/2006 Taylor ..... D30/143
7,628,406 B1 * 12/2009 Thomas ..... B62B 1/14 280/47.18
7,874,436 B2 * 1/2011 Hought ..... B68C 1/002 211/1.51
8,616,383 B1 * 12/2013 Miller ..... B68C 1/002 211/1.51
10,106,181 B1 * 10/2018 Fischhaber ..... B62B 1/208
2011/0094984 A1 * 4/2011 Barletta ..... B62B 1/008 211/85.8
2011/0114584 A1 * 5/2011 Shirey ..... B68B 9/00 211/85.11
2014/0338292 A1 * 11/2014 Abel ..... B68C 1/002 54/44.1

FOREIGN PATENT DOCUMENTS

DE 29607854 U1 * 8/1996 ..... B68C 1/002
DE 202012007289 U1 * 8/2012 ..... B68C 1/002
DE 202017002889 U1 * 7/2017 ..... B68B 9/00
FR 2191548 A5 * 2/1974 ..... B68C 1/002
GB 1252900 A * 11/1971 ..... B68C 1/002
GB 2279859 A * 1/1995 ..... B68C 1/002
WO WO-9500437 A1 * 1/1995 ..... A47B 81/00

* cited by examiner

PORTABLE SADDLE RACK

BACKGROUND OF THE INVENTION

Field of the Invention

The present invention generally relates to a rack device and more particularly relates to a portable saddle rack device.

Description of the Related Art

People who have horses understand and appreciate the importance of a saddle when riding a horse, as the saddle helps to protect the horse against the discomfort of a rider and helps to provide the rider with stability and additional control over the horse. It is common practice for horsemen and stable owners to build supports for storing saddles. This practice is advisable in order to protect the saddles against damage, because saddles are often expensive and adorned with silver ornamentation. Stable owners typically build strong, permanently attached saddle holders as part of the walls of the stables to hold the saddles. Others use semi-portable saddle holders in the form of stands that are placed upon the ground and which have sturdy legs to support the saddle holding member. Although both the fixed wall and the stand types of supports may be used to store saddles, they take up much needed space in small or crowded stables, and such conventional saddle supports cannot be conveniently moved out of the way when not in use.

In addition, it is common for many riders to own more than one saddle and an assortment of horse riding gear. For instance, a person may have multiple horses with each requiring a different saddle, or a person may have one saddle as a "riding saddle", another saddle as a "work" saddle, and another saddle as a "show" saddle. A rider may have multiple bridles, each fitted for a different size horse. Because of these and other reasons, a rider may own multiple saddles and saddle blankets and riding gear that need to be stored or transported. The size, bulkiness, and configuration of the saddles and blankets often make the saddles, blankets and other gear difficult to store or transport.

The foregoing types of saddle supports are not portable and cannot conveniently be taken along with a horse trailer. When a horse owner transports a horse in a trailer to a desired location, the owner may have to place the saddle on the ground since the owner has no saddle support with the owner on the ride and thus at the destination. For instance, for street parades in which the horse is brought to the starting point in a horse trailer, the owner does not have a support to hold the saddle in a convenient place while the owner is saddling the horse. Generally, spirited horses will not stay still while unattended. Consequently, one person cannot take the horse out of the trailer and then go back for the saddle. Instead the owner must first take out the expensive saddle and the saddle blanket, throw them on the ground, lead out the horse from the trailer, and then try to hold the horse while picking up the saddle and the blanket from the ground. Also, when unsaddling the horse at the end of the street parade, the same problem arises, and the owner has to throw the expensive saddle on the ground before leading the horse into the trailer. As a result, it is a very common occurrence for expensive saddles to become damaged and for saddle blankets or pads to get excessively dirty while saddling or unsaddling the horse. One who has spent a large amount of money on a saddle does not want to be tossing the saddle on the ground where it may get scratched, dirty or broken.

Furthermore, because of the weight of a saddle, constantly having to retrieve a saddle from off the ground or from a high shelf may cause unnecessary strain on one's body.

Over the years, various devices have been made to assist people with the storage of saddles and saddle blankets for horses. However, such commonly known devices are of complex construction, largely inefficient in operation, and often result in needing permanent fixtures at numerous locations. There is a need for a compact and portable device for horse owner's to easily and efficiently store, transport, and retrieve saddles, blankets and bridles for horses.

While conventional storage systems for saddles may be suitable for the particular purpose employed, they would not be as suitable for the purposes of the present invention as disclosed hereafter.

Accordingly, there is a need for a compact portable storage system that eliminates or diminishes the disadvantages and problems described above.

As disclosed in this application, the inventor has discovered novel and unique devices and methods for efficient and cost effective storage and transportation of horse saddles, blankets and bridles, which exhibit superlative properties without being dependent on heavy, immobile, expensive or complex components.

Embodiments of the present invention provide for devices and methods as disclosed herein and as defined in the annexed claims which provide for improved mobility, set up, equipment storage and transportation features in order to efficiently anchor, receive, secure, store and transport saddles, blankets and bridles of many types in a multitude of environments and destinations.

SUMMARY OF THE INVENTION

It is one prospect of the present invention to provide one or more novel devices of simple but effective construction which can be applied to many environments to efficiently and effectively anchor, receive, store and transport horse saddles, blankets, bridles and other straps. Additional prospects are to provide one or more devices to hold saddles off the ground in order to protect them from getting damaged, while providing for easier portability of the saddles, as well as to organize and hold saddle blankets and horse-riding bridles and straps off the ground in a tidy portable manner.

The following presents a simplified summary of the present disclosure in a simplified form as a prelude to the more detailed description that is presented herein.

Therefore, in accordance with embodiments of the invention, there is provided a portable saddle rack comprising a preferably elongated vertical support member having an upper end opposite a lower end and a plurality of hooks extending from the upper end. The hooks are preferably configured to removably latch onto or connect to a horizontal support structure, such as a gate of a horse trailer or of another freestanding structure. In one embodiment, the hooks extend from a horizontally oriented hanging member configured at the upper end of the vertical support member, such that the horizontally oriented hanging member in conjunction with the vertical support member forms the shape of a "T". In such embodiment, the plurality of hooks preferably extend upwardly and rearwardly relative to the vertical support member.

The portable saddle rack preferably comprises a saddle blanket support which extends horizontally forwardly from the lower end of the vertical support member. In one embodiment, the blanket support comprises a plurality of elongated legs, which are preferably oriented parallel to each other, and the elongated legs are configured to receive and support one or more saddle blankets. The elongated legs receive and support the saddle blankets when the saddle rack is mounted to a horizontal support structure, such as the gate of a horse trailer.

In a preferred embodiment, the elongated legs are configured to balance the saddle rack on the ground in a freestanding upright position, such as, for instance, when the saddle rack is not mounted to the gate of a horse trailer. In one embodiment, distal ends of the elongated legs are preferably connected to each other.

The portable saddle rack comprises a saddle support extending horizontally forwardly from the vertical support member, and the saddle support is preferably disposed above the blanket support. In a preferred embodiment, the saddle support preferably comprises a plurality of laterally and downwardly extending arms transitioning to horizontally forwardly aligned flank arms that are configured to support a saddle. In such embodiment, the flank arms help enable airflow for a saddle, including airflow between a saddle on the saddle support and a saddle blanket on the blanket support.

In a preferred embodiment, the portable saddle rack comprises a vertical retention member that is disposed at a distal end of the saddle support, and the vertical retention member is configured to restrain the saddle against forward and backward horizontal movement relative to the saddle support.

In yet another preferred embodiment, a bridle hook is disposed at the distal end of the saddle support of the portable saddle rack, and the bridle hook is configured to receive and support one or more horse bridles.

In yet another preferred embodiment, the portable saddle rack comprises an adjustable blanket tensioner which operatively connects a distal end of the saddle blanket support to the distal end of the saddle support. The bridle hook preferably defines a plurality of apertures, and the adjustable blanket tensioner, which connects the distal end of the saddle blanket support to the distal end of the saddle support, is configured to adjustably connect through at least one of the plurality of apertures defined by the bridle hook to tension a saddle blanket against movement when positioned thereupon. In one embodiment, the saddle blanket can be supported by the saddle blanket support when positioned thereupon. In another embodiment, the saddle blanket can be supported by and positioned upon the saddle blanket support and a portion of the adjustable blanket tensioner, which resists horizontal movement of the saddle blanket when connected to the bridle hook.

Preferably, the bridle hook is shaped curvedly, such that is has the shape of a half of a horseshoe, which has a first end and a second end. The first end of the bridle hook is firmly connected to the distal end of the saddle support, and the second end of the bridle hook is extended upwardly and forwardly relative to the first end connected to the saddle support.

In yet another embodiment, the portable saddle rack comprises a retention line, having one end connected to the vertical retention member, which is disposed at the distal end of the saddle support, and having a second end configured to operatively connect to a horn of a saddle when the saddle is positioned on the saddle support. The retention line is preferably a flexible, leather string-like material, such that the second end of the retention line can wrap around the horn of the saddle to provide resistance to the saddle against lateral movement of the saddle when atop the saddle rack. Preferably, the retention line extends freely from an upper end of the vertical retention member and is adapted to enwrap a portion of a horn of a saddle when placed upon the saddle rack, to help retain the saddle upon the portable saddle rack. In such manner, the retention line helps keep the saddle upon the rack by preventing the horn portion of the saddle from shifting away from the vertical retention member.

In one embodiment, the vertical retention member comprises a cushioning pad for dampening impact with the saddle when the saddle is placed upon the saddle rack and when the saddle is transported with the saddle rack.

Through embodiments of the invention, the removably latched saddle rack is configured to slide laterally horizontally along and relative to the horizontal support structure to which the saddle rack is attached.

In one embodiment, the portable saddle rack further comprises an adjustable gate tensioner that connects the lower end of the vertical support member to a portion of the horizontal support structure, such as a lower rung of the gate of a horse trailer, to which the portable saddle rack is attached, in order to restrain the lower end of the vertical support member against radial movement relative to an upper rung of the horizontal support structure.

In yet another embodiment, a portable horse saddle and blanket rack is provided for transporting a saddle in detachable connection to a horse trailer. The portable horse saddle and blanket rack comprises a vertical support member having an upper end opposite a lower end. In one embodiment, the plurality of hooks extend from the upper end and the hooks are configured to removably latch onto a horizontal gate structure of a horse trailer for transporting the saddle.

In one embodiment, the portable horse saddle and blanket rack comprises a saddle blanket support extending horizontally from the lower end of the vertical support member, and the blanket support preferably comprises an arrangement of a plurality of elongated parallel legs that are configured to (i) support and transport one or more saddle blankets when the saddle rack is latched to the gate and (ii) achieve an unattended upright freestanding balanced position when the saddle and blanket rack is not latched to the gate. The plurality of elongated parallel legs are preferably connected to each other at a distal end of each thereof and configured to balance the portable saddle rack in a freestanding upright position upon the ground, such as, for instance, when the portable horse saddle and blanket rack is detached from the horse trailer gate structure.

The portable horse saddle and blanket rack preferably comprises a saddle support extending horizontally from the vertical support member, disposed above the blanket support, and the saddle support preferably comprises a plurality of laterally and downwardly extending arms transitioning to horizontally aligned flank arms configured to support the saddle.

In one embodiment, a bridle hook is disposed at a distal end of the saddle support of the portable horse saddle and blanket rack, and the bridle hook is configured to receive and support one or more horse bridles.

The portable horse saddle and blanket rack preferably includes an adjustable blanket tensioner that operatively connects a distal end of the saddle blanket support to the distal end of the saddle support.

In a preferred embodiment, the bridle hook of the portable horse saddle and blanket rack extends outwardly from the distal end of the saddle support and defines a plurality of apertures through one of which the saddle blanket tensioner will connect. Through such embodiments, the saddle blanket tensioner may be adjusted to accommodate saddle blankets of various sizes when placed upon the saddle blanket support, by connecting the blanket tensioner to differing apertures defined by the curved bridle hook.

In one embodiment, the portable horse saddle and blanket rack further comprises a vertical retention member disposed at the distal end of the saddle support, and the vertical retention member is configured to help retain the saddle on the saddle support by restraining the saddle against horizontal movement relative to the saddle support.

In another embodiment, the portable horse saddle and blanket rack further comprises a retention line extending from an upper end of the vertical retention member and adapted to enwrap a portion of a horn of the saddle when the saddle is placed upon the saddle rack for transport.

Through embodiments of the invention, the removably latched portable horse saddle and blanket rack is configured to slide horizontally along and relative to the horizontal gate structure of the horse trailer to which is may be latched.

In one embodiment, the portable horse saddle and blanket rack further comprises an adjustable gate tensioner connecting the lower end of the vertical support member to a portion of the gate structure of the horse trailer in order to restrain the lower end of the vertical support member against lateral movement relative to the gate structure.

In yet another embodiment, a storage and transportation system for storing and transporting at least one horse saddle, horse saddle blanket, and horse bridle when detachably connected to a horizontal member of a horse trailer is provided, having an elongated saddle support body disposed between a vertical retention member and a vertical support member. Preferably, the vertical retention member and the vertical support member are adapted to restrain a saddle therebetween against horizontal movement relative thereto during storage and transportation of the saddle upon the saddle support body.

Preferably, the vertical support member has an upper end opposite a lower end, and the upper end has parallel hooks adapted for detachable connection to the horizontal member of the horse trailer. The lower end preferably includes a saddle blanket support member extending therefrom. The saddle blanket support member preferably includes an adjustable tensioner operatively connected thereto.

In a preferred embodiment, a bridle hook is fixed to the saddle support body for receiving and supporting one or more horse bridles, and the bridle hook preferably defines one or more apertures adapted to receive and connect to the saddle blanket support adjustable tensioner to restrain the saddle blanket against horizontal movement, relative to the saddle blanket support member, during transportation.

In one embodiment of the storage and transportation system, the vertical retention member includes a saddle retention line operatively connected to the vertical retention member, and the saddle retention line is adapted to enwrap a horn of a saddle to secure the saddle against movement away from and relative to the vertical retention member of the saddle support body.

In yet another embodiment, the storage and transportation system further comprising an adjustable gate tensioner that is configured to removably connect the vertical support member to a portion of the horse trailer, in order to help restrain the vertical support member against radial movement relative to the gate portion of the horse trailer.

While conventional saddle racks are typically heavy, immobile and complex, embodiments of the present invention can conveniently be either easily connected to or disconnected from an existing gate structure, or stored freestanding self-balanced while unconnected and unattended.

These and other features, aspects, and advantages of the present invention will become better understood with reference to the following description and appended claims.

BRIEF DESCRIPTION OF THE DRAWINGS

Illustrative embodiments of the present invention are described herein with reference to the accompanying drawings, in which like numerals throughout the figures identify substantially similar components, in which.

DETAILED DESCRIPTION

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure or manner. It should be understood that the devices, materials, methods, procedures, and techniques described herein are presently representative of various embodiments. Other embodiments of the disclosure will readily suggest themselves to such skilled persons having the benefit of this disclosure.

As used herein, "axis" means a real or imaginary straight line about which a three-dimensional body is symmetrical. A "vertical axis" means an axis perpendicular to the ground (or put another way, an axis extending upwardly and downwardly). A "horizontal axis" means an axis parallel to the ground.

As used herein, homogeneous is defined as the same in all locations, and a homogeneous material is a material of uniform composition throughout that cannot be mechanically separated into different materials. Examples of "homogeneous materials" are certain types of plastics, ceramics, metals, alloys, paper, board, resins, high-density polyethylene and rubber.

Figure 1:
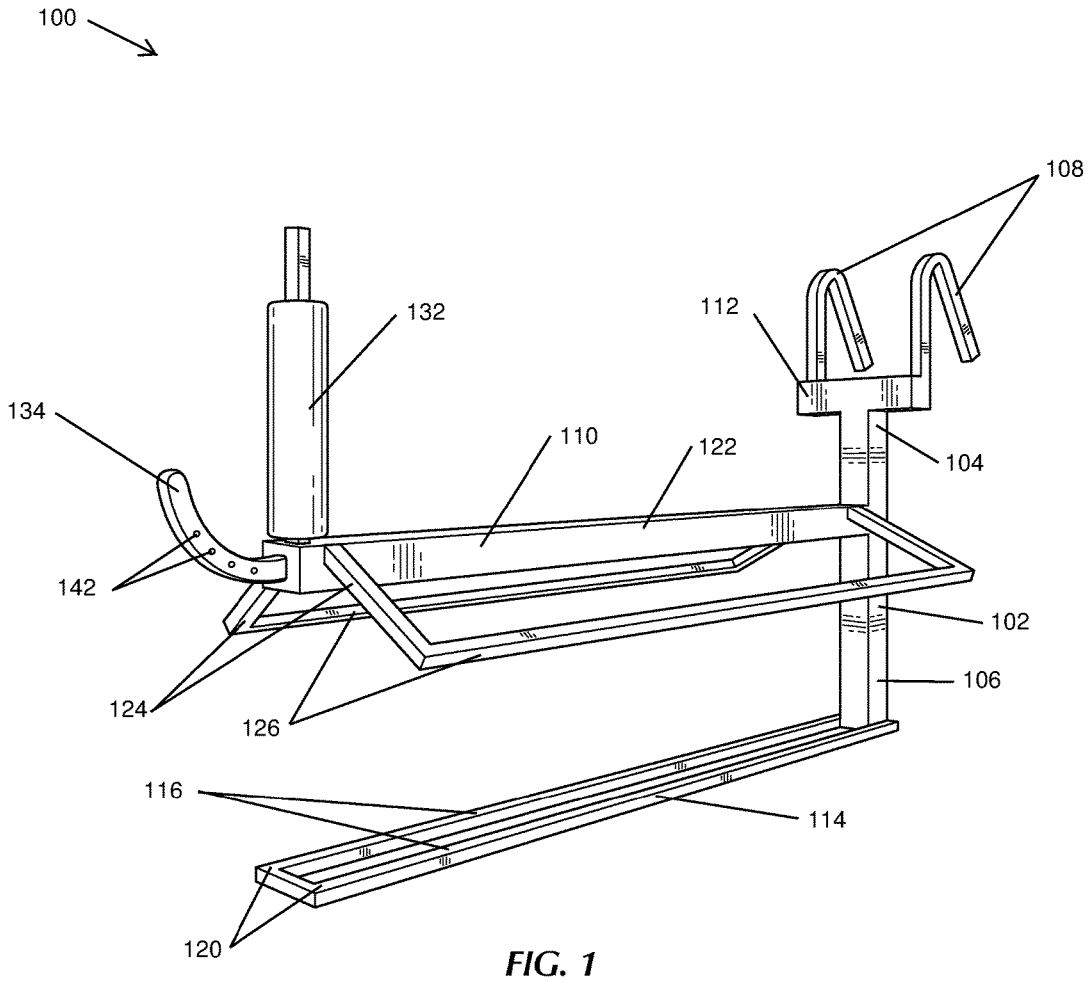
FIG. 1 is a front right perspective view of an exemplary portable saddle rack in accordance with embodiments of the invention.
Figure 2:
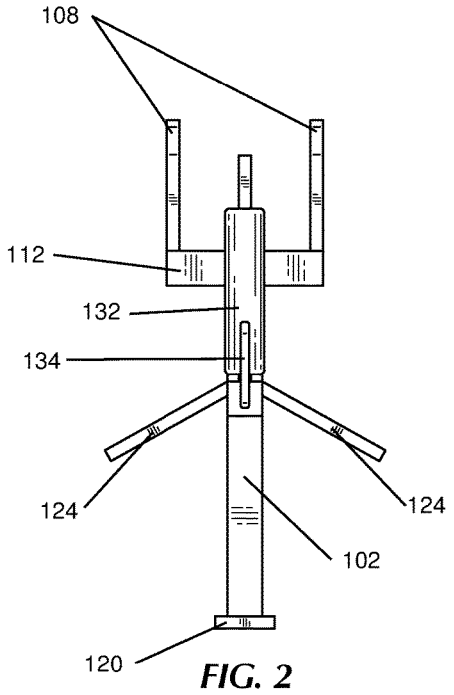
FIG. 2 is a front elevation view thereof.
Figure 3:
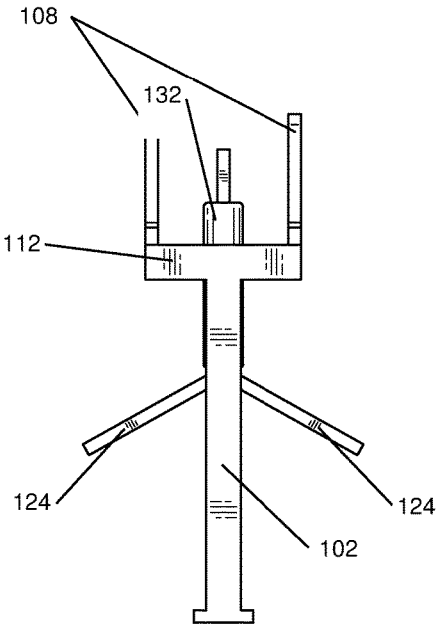
FIG. 3 is a back elevation view thereof.
Figure 4:
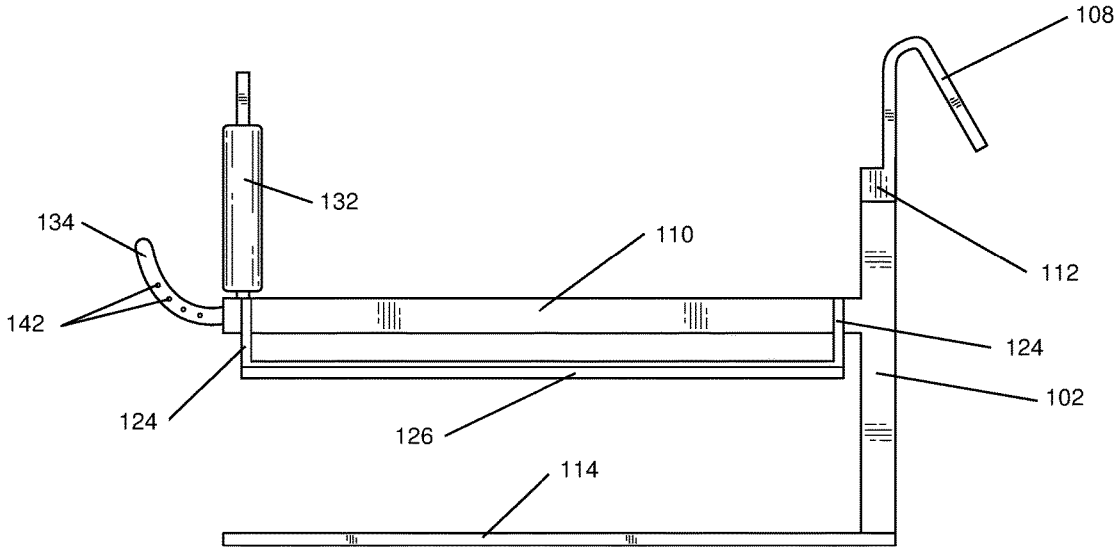
FIG. 4 is a right elevation view thereof, the left elevation view being mirror image of the right elevation view.

Referring initially to FIGS. 1-4, the basic constructional details and principles of operation of one embodiment of a portable saddle rack 100 according to a preferred embodiment of the present invention will be discussed. Referring to FIG. 1, in accordance with embodiments of the invention, there is provided a portable saddle rack 100 comprising a preferably elongated vertical support member 102 having an upper end 104 opposite a lower end 106 and a plurality of hooks 108 extending from the upper end 104. The hooks 108 are preferably configured to removably latch onto or connect to a horizontal support structure 110, such as a gate of a horse trailer or of another freestanding structure, for example. In one embodiment, the hooks 108 preferably extend from a horizontally oriented hanging member 112 configured at the upper end 104 of the vertical support member 102, such that the horizontally oriented hanging member 112, in conjunction with the vertical support member 102, forms the shape of a "T". In such embodiment, the plurality of hooks 108 preferably extends upwardly and rearwardly relative to the vertical support member 102.

The portable saddle rack 100 preferably includes a saddle blanket support 114 which preferable extends horizontally forwardly from the lower end 106 of the vertical support member 102. In one embodiment, the blanket support 114 may include a plurality of elongated legs 116, which are preferably oriented parallel to each other. The elongated legs 116 are preferably configured to receive and support one or more saddle blankets 118, as show in FIG. 5. The elongated legs 116 receive and support the saddle blankets 118 when the saddle rack 100 is mounted to a horizontal support structure 110, such as the gate of a horse trailer, for example.

Figure 5:
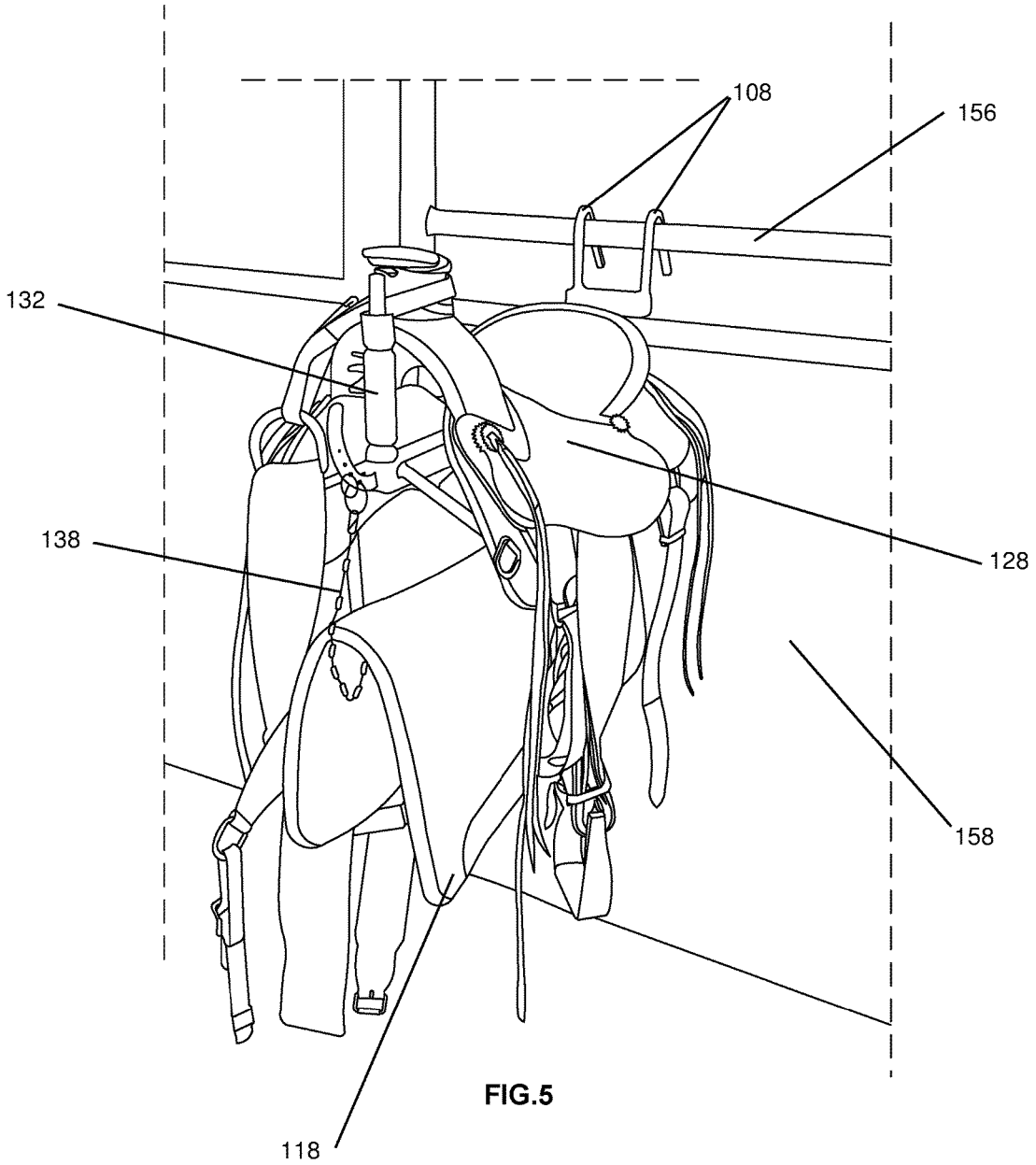
FIG. 5 is a front right perspective view of a portable saddle rack supporting an exemplary saddle, saddle blanket and saddle straps, while the portable saddle rack is removably connected to an exemplary horizontal gate of a horse barn, in accordance with embodiments of the invention.
Figure 6:
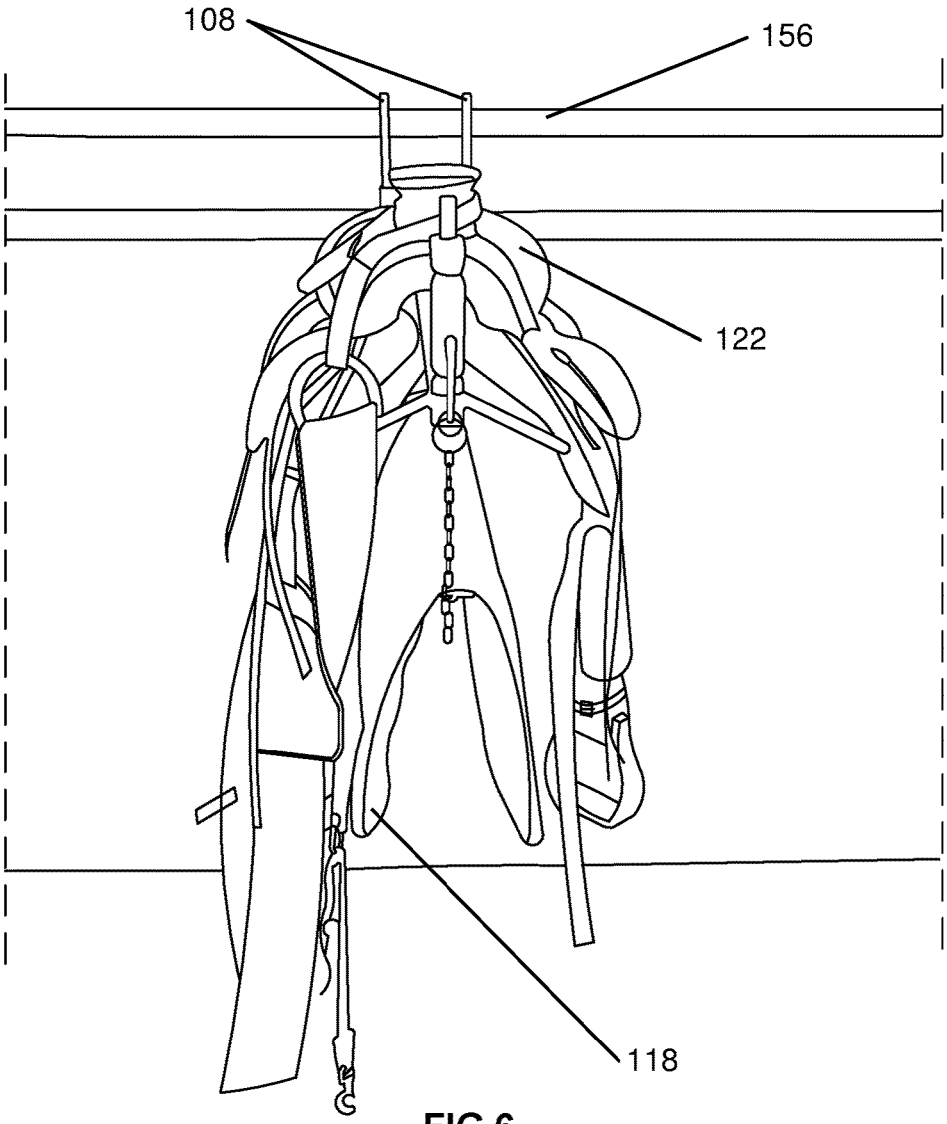
FIG. 6 is a front elevation view thereof.

Referring to FIGS. 5 and 6, in a preferred embodiment, the elongated legs 116 are preferably configured to balance the saddle rack 100 on the ground in a freestanding upright position, such as, for instance, when the saddle rack 100 is not mounted to the gate of a horse trailer. In one embodiment, distal ends 120 of the elongated legs 116 are preferably connected to each other.

In an embodiment, the portable saddle rack 100 comprises a saddle support 122 extending horizontally forwardly from the vertical support member 102, and the saddle support 122 is preferably disposed above the blanket support 114. In a preferred embodiment, the saddle support 122 preferably includes a plurality of laterally and downwardly extending arms 124 transitioning to horizontally forwardly aligned flank arms 126 that are configured to support a saddle 128. In such embodiment, the flank arms 126 help enable airflow for a saddle 128, including airflow between a saddle 128 on the saddle support 122 and a saddle blanket 118 on the blanket support 114.

In a preferred embodiment, the portable saddle rack 100 preferably includes a vertical retention member 130 that is disposed at a distal end 132 of the saddle support 122, and the vertical retention member 130 is preferably configured to restrain the saddle 128 against forward and backward horizontal movement relative to the saddle support 122.

In yet another preferred embodiment, a bridle hook 134 is disposed at the distal end 132 of the saddle support 122 of the portable saddle rack 100, and the bridle hook 134 is configured to receive and support one or more horse bridles 136.

Figure 7:
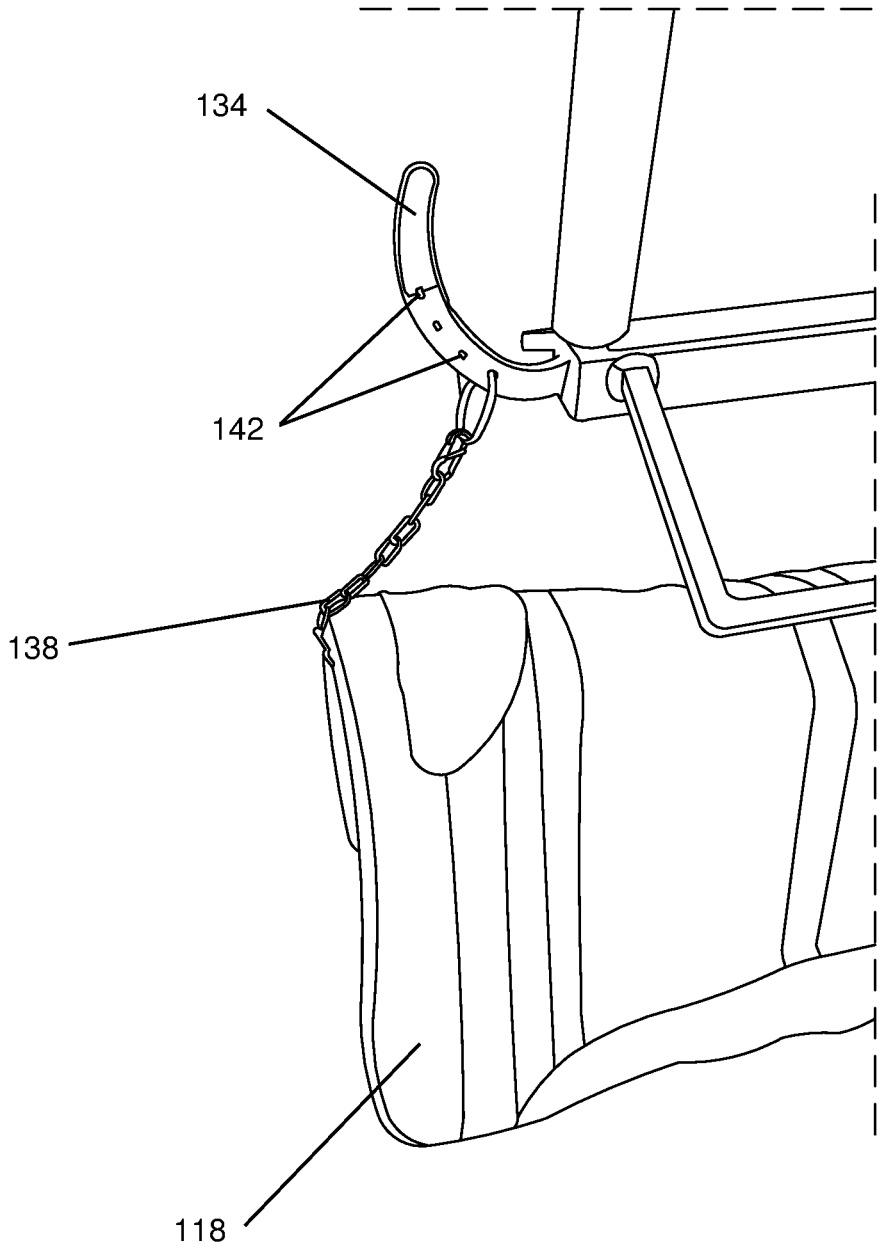
FIG. 7 is a front right perspective view of a portion of a portable saddle rack, illustrating an adjustable blanket tensioner operatively connected to a bridle hook, restraining an exemplary saddle blanket, in accordance with embodiments of the invention.

Referring to FIG. 7, in yet another preferred embodiment, the portable saddle rack 100 preferably includes an adjustable blanket tensioner 138 which operatively connects a distal end 140 of the saddle blanket support 114 to the distal end 132 of the saddle support 122. The bridle hook 134 preferably defines a plurality of apertures 142, and the adjustable blanket tensioner 138, which connects the distal end 140 of the saddle blanket support 114 to the distal end 132 of the saddle support 122, is configured to adjustably connect through at least one of the plurality of apertures 142 defined by the bridle hook 134 to tension a saddle blanket 118 against movement when positioned thereupon. In one embodiment, the saddle blanket 118 can be supported by the saddle blanket support 114 when positioned thereupon. In another embodiment, the saddle blanket 118 can be supported by and positioned upon the saddle blanket support 114 and a portion of the adjustable blanket tensioner 138, which resists horizontal movement of the saddle blanket 118 when connected to the bridle hook 134.

Preferably, the bridle hook 134 is shaped curvedly, such that is has the shape of a half of a horseshoe, for example, which has a first end 136 and a second end 138. In one embodiment, the first end 136 of the bridle hook 134 is firmly connected to the distal end 132 of the saddle support 122, and the second end 138 of the bridle hook 134 is extended upwardly and forwardly relative to the first end 136 connected to the saddle support 122.

In yet another embodiment, the portable saddle rack 100 preferably includes a retention line 144, having one end 146 connected to the vertical retention member 130, which is disposed at the distal end 132 of the saddle support 122, and having a second end 148 configured to operatively connect to a horn 150 of a saddle 128 when the saddle 128 is positioned on the saddle support 122. The retention line 144 is preferably a flexible, leather string-like material, such that the second end 148 of the retention line 144 can wrap around the horn 150 of the saddle 128 to provide resistance to the saddle 128 against lateral movement of the saddle 128 when atop the saddle rack 100. Preferably, the retention line 144 extends freely from an upper end 152 of the vertical retention member 130 and is adapted to enwrap a portion of a horn 150 of a saddle 128 when placed upon the saddle rack 122, to help retain the saddle 128 upon the portable saddle rack 122. In this exemplary embodiment, the retention line 144 helps keep the saddle upon the rack 100 by preventing the horn portion 150 of the saddle 128 from shifting away from the vertical retention member 130.

In one embodiment, the vertical retention member 130 includes a cushioning pad 152 for dampening impact with the saddle 128 when the saddle 128 is placed upon the saddle rack 100 and when the saddle 128 is transported with the saddle rack 100.

Through embodiments of the invention, the removably latched saddle rack 100 is configured to slide laterally horizontally along and relative to the horizontal support structure 110 to which the saddle rack 100 is attached.

Figure 8:
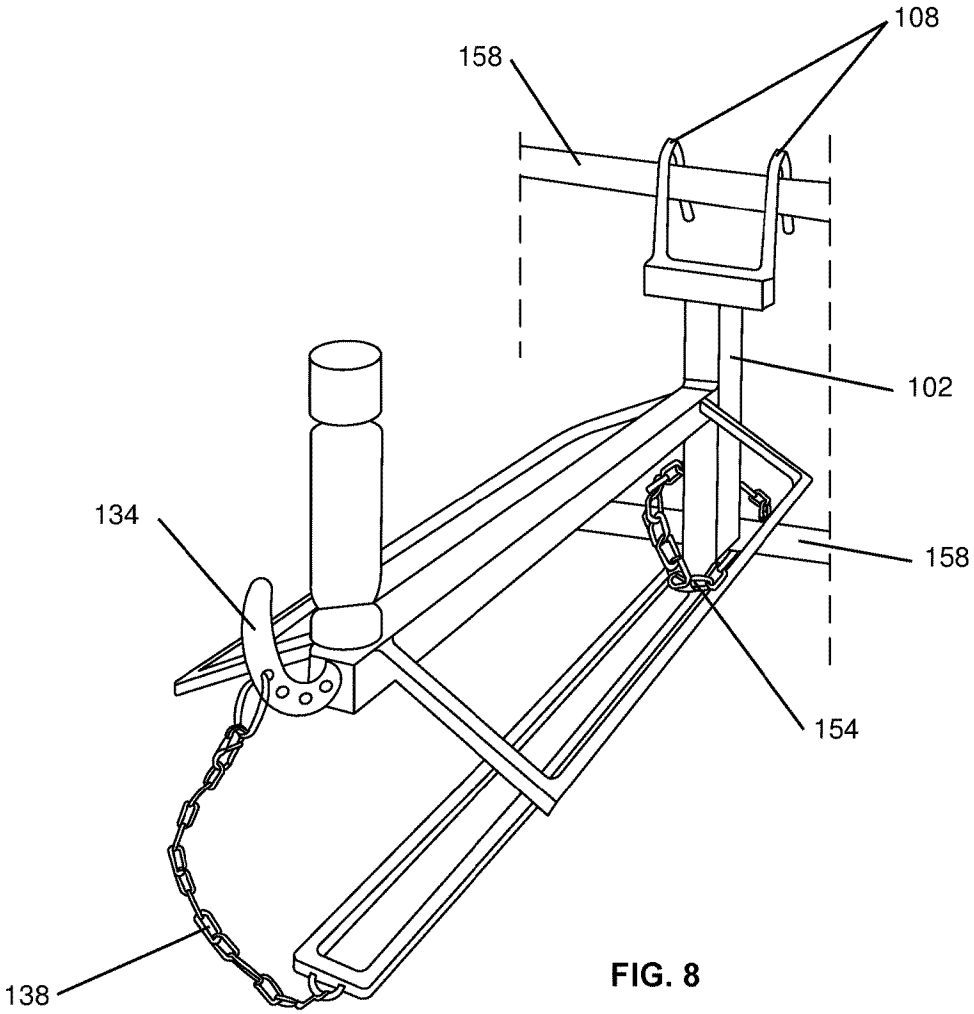
FIG. 8 is a front right perspective view of a portable saddle rack illustrating an adjustable gate tensioner connecting the rack to a portion of an exemplary horizontal support structure, in accordance with embodiments of the invention.
Figure 9:
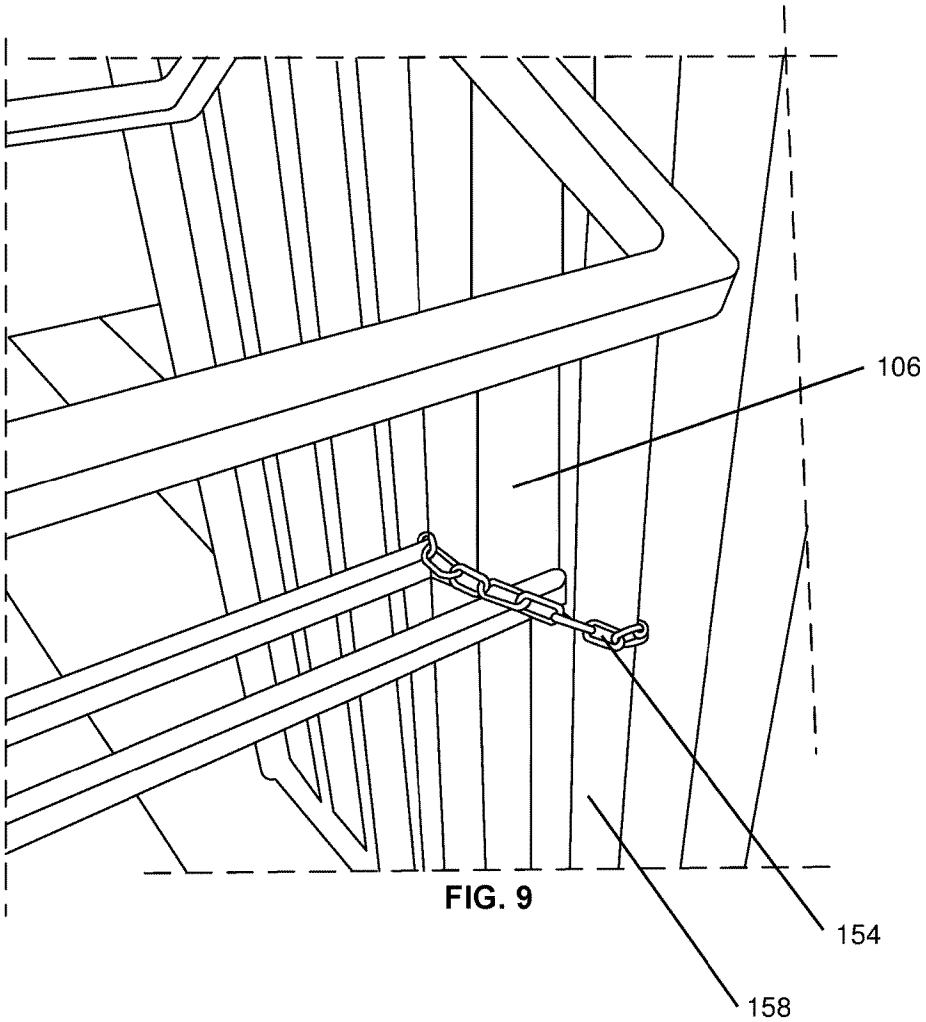
FIG. 9 is close-up view of a perspective view of an adjustable gate tensioner connecting the rack to a portion of an exemplary vertical support structure, in accordance with embodiments of the invention.

Referring to FIGS. 8 and 9, in one embodiment, the portable saddle rack 100 further preferably includes an adjustable gate tensioner 154 that connects the lower end 106 of the vertical support member 102 to a portion of the horizontal support structure 110, such as a lower rung of the gate of a horse trailer, for example, to which the portable saddle rack 100 is attached, in order to restrain the lower end 106 of the vertical support member 102 against radial movement relative to an upper rung of the horizontal support structure 110.

Figure 10:
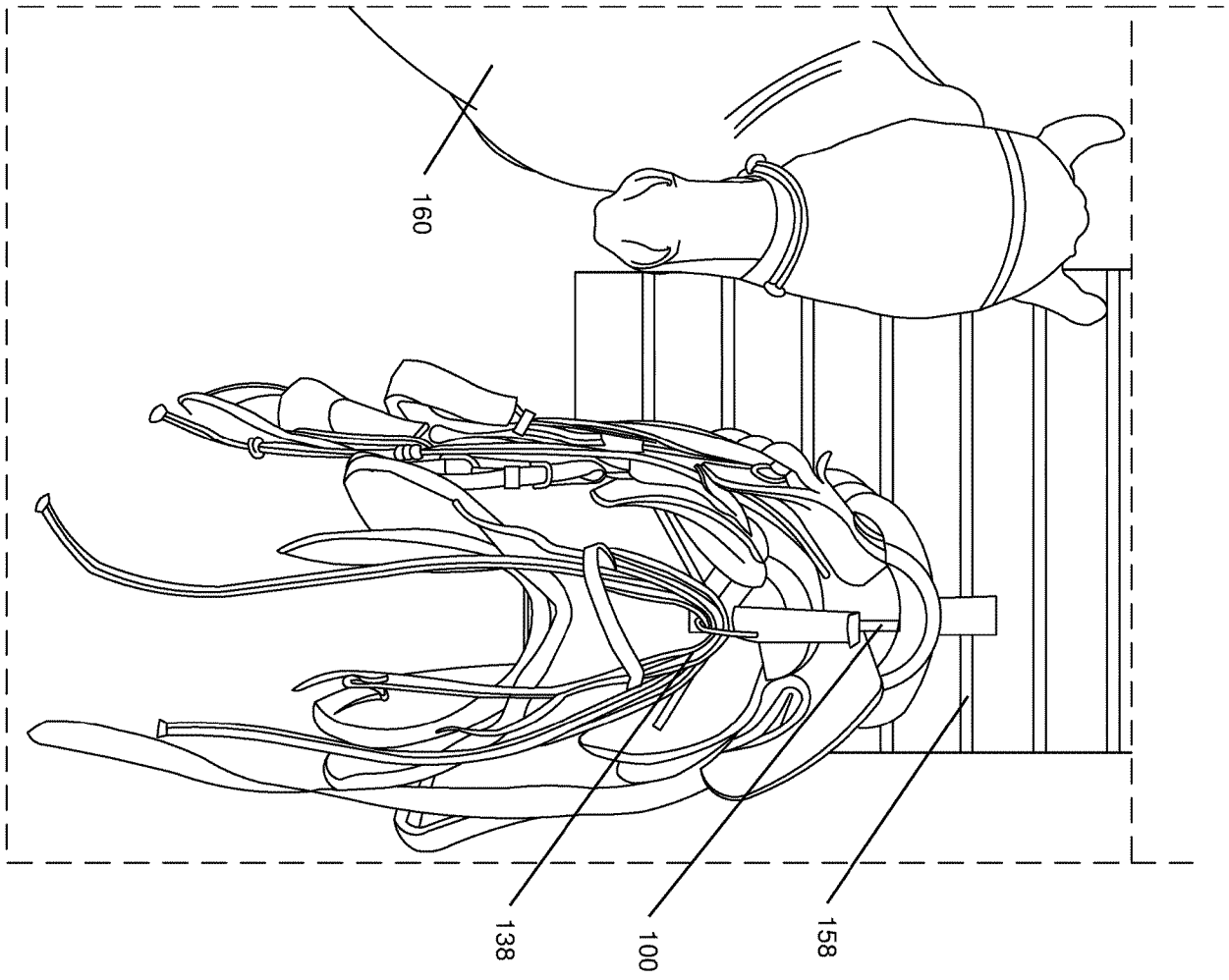
FIG. 10 is a front elevation view of a portable saddle rack supporting an exemplary saddle, saddle blanket and saddle straps, while the portable saddle rack is removably connected to an exemplary horizontal gate of a horse trailer, and illustrating an exemplary horse, in accordance with embodiments of the invention.

As can been seen in FIG. 10, the vertical retention member 130 retains the saddle 128 against horizontal movement upon the saddle rack arm 124 and maintains separation of the saddle 128 from the one or more bridles 136 hanging from the bridle hook 134, which helps keep the bridle leather from cracking.

Figure 11:
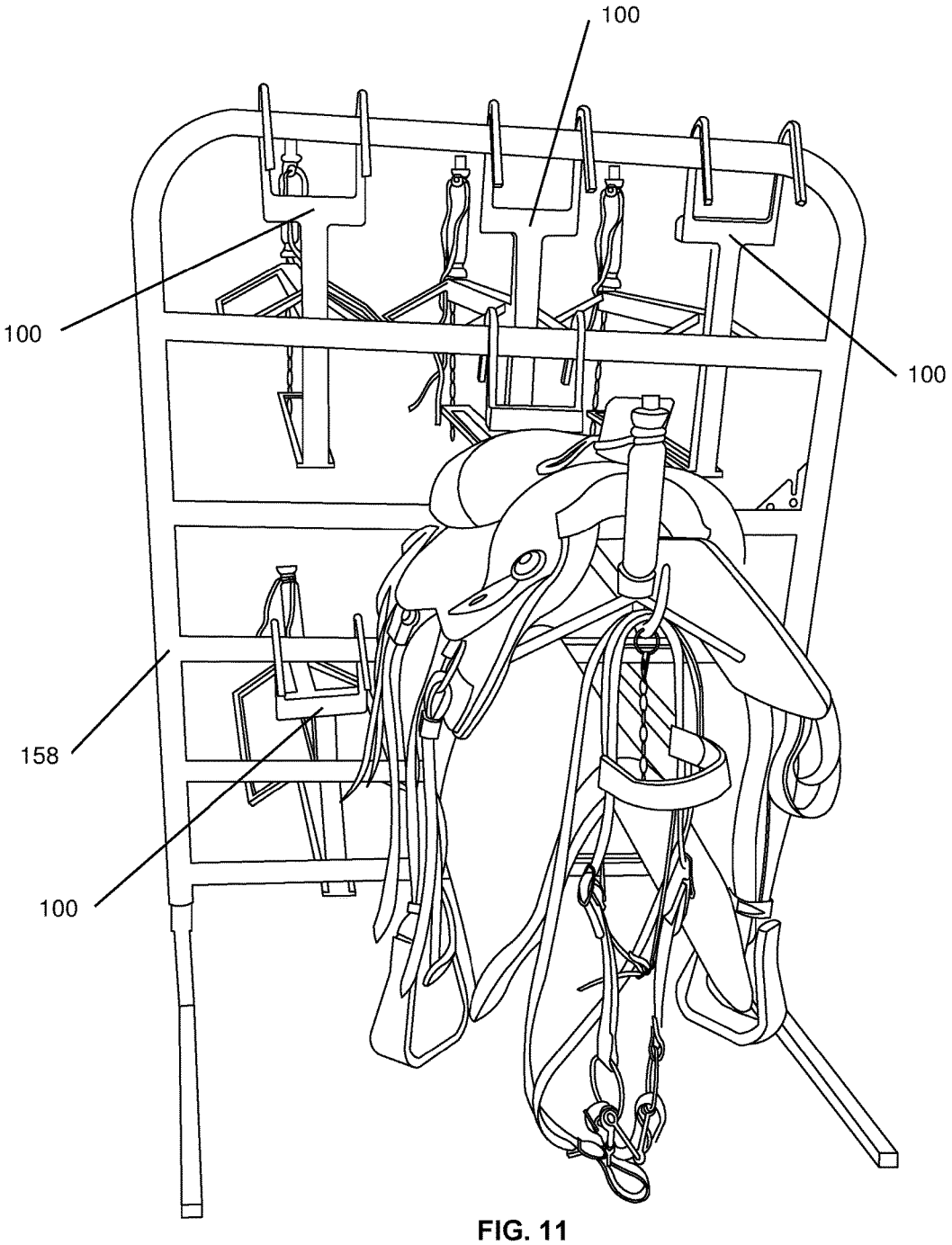
FIG. 11 is a perspective view of a plurality of portable saddle racks removably connected to an exemplary freestanding rack structure, and illustrating an exemplary saddle, saddle blanket and saddle straps, in accordance with embodiments of the invention.
Figure 12:
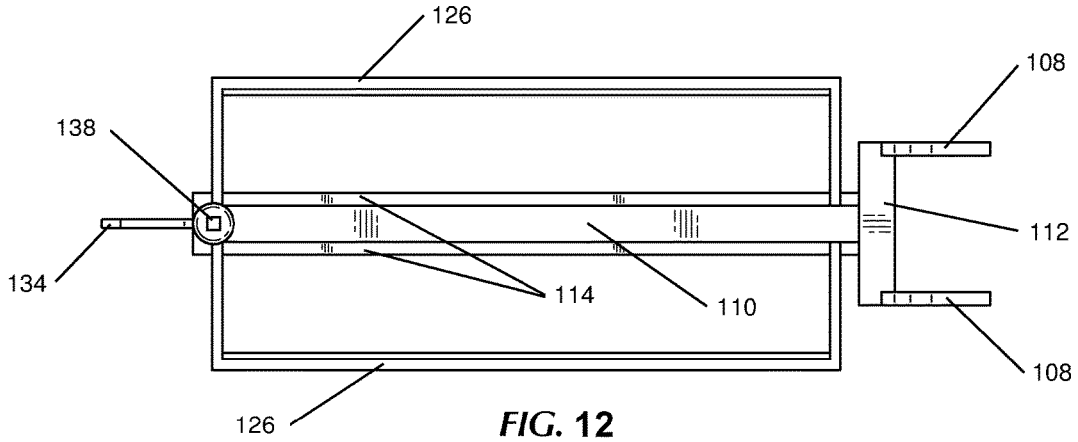
FIG. 12 is a top plan view of a portable saddle rack, in accordance with embodiments of the invention.
Figure 13:
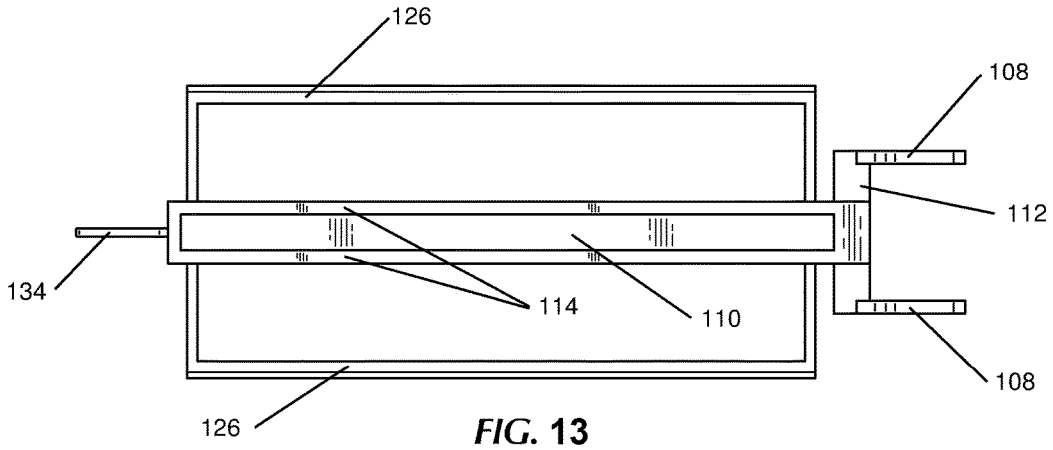
FIG. 13 is a bottom plan view of a portable saddle rack, in accordance with embodiments of the invention.

As can been seen in FIG. 11, one advantage of the rack 100 is a device that may hold one or more saddles 128 off of the ground in order to protect them from getting damaged as well as allowing for easier retrieval of the saddles without physical strain. One or more of the devices 100 may be attached to a trailer 156, which may permit easy transportation of the saddle. The rack 100 may also prevent the saddles 128 from being thrown in the back of a truck or trailer, which could consequently damage the saddles 128. The rack 100 may include one or more saddle supports 122 sized and configured to support at least a portion of a saddle 128. The rack 100 may also include one or more pad supports sized and configured to support at least a portion of one or more pads, such as a saddle pad and/or a saddle blanket. Another advantage of the rack 100 is that it may be moved laterally or horizontally relative to the trailer 156 without being removed from the horizontal gate structure 158 which vertically upholds it.

In yet another embodiment, a portable horse saddle and blanket rack 100 is provided for transporting a saddle 128 in detachable connection to a horse trailer 156. The portable horse saddle and blanket rack 100 comprises a vertical support member 102 having an upper end 104 opposite a lower end 106. In one embodiment, the plurality of hooks extend 108 from the upper end 104 and the hooks 108 are configured to removably latch onto a horizontal gate structure 158 of a horse trailer 156 for transporting the saddle 128.

In one embodiment, the portable horse saddle and blanket rack 100 comprises a saddle blanket support 114 extending horizontally from the lower end 106 of the vertical support member 102, and the blanket support 114 preferably includes an arrangement of a plurality of elongated parallel legs 118 that are configured to support and transport one or more saddle blankets 118 when the saddle rack 100 is latched to the gate 158 or any other structure and achieve an unattended upright freestanding balanced position when the saddle and blanket rack 100 is not latched to the gate 158 or similar structure. The plurality of elongated parallel legs 116 are preferably connected to each other at a distal end 120 of each thereof and configured to balance the portable saddle rack 100 in a freestanding upright position upon the ground 160, such as, for instance, when the portable horse saddle and blanket rack 100 is detached from the horse trailer gate structure 158.

The portable horse saddle and blanket rack 100 preferably includes a saddle support 122 extending horizontally from the vertical support member 102, disposed above the blanket support 114, and the saddle support 114 preferably includes a plurality of laterally and downwardly extending arms 124 transitioning to horizontally aligned flank arms 126 configured to support the saddle 128.

In one embodiment, a bridle hook 134 is disposed at a distal end 132 of the saddle support 122 of the portable horse saddle and blanket rack 100, and the bridle hook 134 is configured to receive and support one or more horse bridles 136.

The portable horse saddle and blanket rack 100 preferably includes an adjustable blanket tensioner 138 that operatively connects a distal end 140 of the saddle blanket support 114 to the distal end 132 of the saddle support 122.

In a preferred embodiment, the bridle hook 134 of the portable horse saddle and blanket rack 100 extends outwardly from the distal end 140 of the saddle support 122 and preferably defines a plurality of apertures 142 through one of which the saddle blanket tensioner 138 may connect. Through such embodiments, the saddle blanket tensioner 138 may be adjusted to accommodate saddle blankets 118 of various sizes when placed upon the saddle blanket support 122, by connecting the blanket tensioner 138 to differing apertures 142 defined by the curved bridle hook 134.

In one embodiment, the portable horse saddle and blanket rack 100 preferably includes a vertical retention member 130 disposed at the distal end 132 of the saddle support 122, and the vertical retention member 130 is preferably configured to help retain the saddle 128 on the saddle support 122 by restraining the saddle 128 against horizontal movement relative to the saddle support 114.

In another embodiment, the portable horse saddle and blanket rack 100 further comprises a retention line 144 extending from an upper end of the vertical retention member 130 and adapted to enwrap a portion of a horn 150 of the saddle 128 when the saddle is placed upon the saddle rack 100 for transport.

Through embodiments of the invention, the removably latched portable horse saddle and blanket rack 100 is preferably configured to slide horizontally along and relative to the horizontal gate structure 158 of the horse trailer 156 to which is may be latched.

In one embodiment, the portable horse saddle and blanket rack 100 further comprises an adjustable gate tensioner 154 connecting the lower end 106 of the vertical support member 102 to a portion of the gate structure 158 of the horse trailer 156 in order to restrain the lower end 106 of the vertical support member 102 against lateral movement relative to the gate structure 158.

In yet another embodiment, a storage and transportation system 100 for storing and transporting preferably includes at least one horse saddle 128, horse saddle blanket 118, and horse bridle 136 when detachably connected to a horizontal member 110 of a horse trailer 156, having an elongated saddle support body 122 disposed between a vertical retention member 130 and a vertical support member 102. Preferably, the vertical retention member 130 and the vertical support member 102 are preferably adapted to restrain a saddle 128 therebetween against horizontal movement relative thereto during storage and transportation of the saddle 128 upon the saddle support body 122.

Preferably, the vertical support member 102 has an upper end 104 opposite a lower end 106, and the upper end preferably has parallel hooks 108 adapted for detachable connection to the horizontal member 158 of the horse trailer 156. The lower end 106 preferably includes a saddle blanket support member 114 extending therefrom. The saddle blanket support member 114 preferably includes an adjustable tensioner operatively connected thereto.

In a preferred embodiment, a bridle hook 134 may be fixed to the saddle support body 122 for receiving and supporting one or more horse bridles 136, and the bridle hook 134 preferably defines one or more apertures 142 adapted to receive and connect to the saddle blanket support adjustable tensioner 138 to restrain the saddle blanket 118 against horizontal movement, relative to the saddle blanket support member 122, during transportation.

In one embodiment of the storage and transportation system 100, the vertical retention member 130 preferably includes a saddle retention line 144 operatively connected to the vertical retention member 130, and the saddle retention line 144 is adapted to enwrap a horn 150 of a saddle to secure the saddle 128 against movement away from and relative to the vertical retention member 130 of the saddle support body 122.

In yet another embodiment, the storage and transportation system 100 preferably includes an adjustable gate tensioner 154 that is configured to removably connect the vertical support member 102 to a portion of the horse trailer 156, in order to help restrain the vertical support member 102 against radial movement relative to the gate portion 158 of the horse trailer 156.

Except as may be expressly otherwise indicated, the article "a" or "an" if and as used herein is not intended to limit, and should not be construed as limiting, the description or a claim to a single element to which the article refers. Rather, the article "a" or "an" if and as used herein is intended to cover one or more such elements, unless the text expressly indicates otherwise.

This invention is susceptible to considerable variation within the spirit and scope of the appended claims.

The claimed invention is:

1. A portable saddle rack comprising:

a vertical support member having an upper end opposite a lower end;

a plurality of hooks extending from the upper end wherein said hooks are configured to removably latch onto a horizontal support structure;

a saddle blanket support extending horizontally from the lower end of the vertical support member, said blanket support comprising a plurality of elongated legs configured to support one or more saddle blankets;

a saddle support extending horizontally from the vertical support member, said saddle support disposed above the blanket support, said saddle support comprising a plurality of laterally and downwardly extending arms transitioning to horizontally aligned flank arms configured to support a saddle;

an adjustable blanket tensioner connecting a distal end of the saddle blanket support to the distal end of the saddle support; and a vertical retention member disposed at a distal end of the saddle support and configured to restrain the saddle against horizontal movement relative thereto.

2. The portable saddle rack of claim 1, further comprising a bridle hook disposed at the distal end of the saddle support of the portable saddle rack and configured to receive and support one or more horse bridles.

3. The portable saddle rack of claim 2, said adjustable blanket tensioner connecting a distal end of the saddle blanket support to the distal end of the saddle support, wherein the bridle hook defines a plurality of apertures, wherein said adjustable blanket tensioner connecting the distal end of the saddle blanket support to the distal end of the saddle support is configured to connect through at least one of the plurality of apertures defined by the bridle hook to tension a saddle blanket against movement when positioned thereupon.

4. The portable saddle rack of claim 1, further comprising a retention line extending from the vertical retention member and adapted to enwrap a portion of a horn of a saddle when placed upon the saddle rack.

5. The portable saddle rack of claim 1, wherein said removably latched rack is configured to slide horizontally along and relative to the horizontal support structure.

6. The portable saddle rack of claim 1, the vertical retention member comprising a cushioning pad for dampening impact with the saddle when placed upon the saddle rack.

7. The portable saddle rack of claim 1, further comprising an adjustable gate tensioner connecting the lower end of the vertical support member to a portion of the horizontal support structure to restrain said lower end against radial movement relative to the horizontal support structure.

8. A portable horse saddle and blanket rack for transporting a saddle in detachable connection to a horse trailer, comprising:

a vertical support member having an upper end opposite a lower end;

a plurality of hooks extending from the upper end wherein said hooks are configured to removably latch onto a horizontal gate structure of a horse trailer for transporting the saddle;

a saddle blanket support extending horizontally from the lower end of the vertical support member, said blanket support comprising an arrangement of a plurality of elongated parallel legs configured to (i) support and transport one or more saddle blankets when the saddle rack is latched and (ii) achieve an unattended upright freestanding balanced position when the saddle and blanket rack is not latched;

a saddle support extending horizontally from the vertical support member, disposed above the blanket support, said saddle support comprising a plurality of laterally and downwardly extending arms transitioning to horizontally aligned flank arms configured to support the saddle;

an adjustable blanket tensioner connecting a distal end of the saddle blanket support to the distal end of the saddle support; and a bridle hook disposed at a distal end of the saddle support of the portable horse saddle and blanket rack configured to receive and support one or more horse bridles.

9. The portable horse saddle and blanket rack of claim 8, wherein the bridle hook defines a plurality of apertures and wherein said connecting the distal end of the saddle blanket support to the distal end of the saddle support comprises connecting the blanket tensioner through at least one of the plurality of apertures defined by the bridle hook.

10. The portable horse saddle and blanket rack of claim 8, further comprising a vertical retention member disposed at the distal end of the saddle support and configured to restrain the saddle against horizontal movement relative thereto.

11. The portable horse saddle and blanket rack of claim 10, further comprising a retention line extending from an upper end of the vertical retention member and adapted to enwrap a portion of a horn of the saddle when placed upon the saddle rack for transport.

12. The portable horse saddle and blanket rack of claim 8, wherein said removably latched rack is configured to slide horizontally along and relative to the horizontal gate structure of the horse trailer.

13. The portable horse saddle and blanket rack of claim 8, further comprising an adjustable gate tensioner connecting the lower end of the vertical support member to a portion of the gate structure of the horse trailer to restrain said lower end against lateral movement relative to the gate structure.

14. A storage and transportation system for storing and transporting at least one horse saddle, horse saddle blanket, and horse bridle when detachably connected to a horizontal member of a horse trailer, comprising:

an elongated saddle support body disposed between a vertical retention member and a vertical support member, said vertical retention member and vertical support member adapted to restrain a saddle therebetween against horizontal movement relative thereto during transportation;

the vertical support member having an upper end opposite a lower end, said upper end comprising parallel hooks adapted for detachable connection to the horizontal member of the horse trailer, said lower end comprising a saddle blanket support member extending therefrom, the saddle blanket support member having an adjustable tensioner operatively connected thereto;

a bridle hook fixed to the saddle support body for receiving and supporting one or more horse bridles, wherein said bridle hook defines one or more apertures adapted to receive and connect to the saddle blanket support adjustable tensioner to restrain the saddle blanket against horizontal movement relative to said saddle blanket support member during transportation.

15. The storage and transportation system of claim 14, the vertical retention member comprising a saddle retention line operatively connected thereto and adapted to enwrap a horn of a saddle to secure said saddle against movement away from and relative to said vertical retention member.

16. The storage and transportation system of claim 14, further comprising an adjustable gate tensioner connecting the vertical support member to a portion of the horse trailer to restrain the vertical support member against radial movement relative to the portion of the horse trailer.

* * * * *